US006598815B2

(12) United States Patent
Hsieh

(10) Patent No.: US 6,598,815 B2
(45) Date of Patent: Jul. 29, 2003

(54) BREAKER OF REINFORCED GLASS

(76) Inventor: Yung-Tsung Hsieh, No. 11, Lane 146, Fuyi Rd., Taiping City, Taichung (TW), 411

( * ) Notice: Subject to any disclaimer, the term of this patent is extended or adjusted under 35 U.S.C. 154(b) by 52 days.

(21) Appl. No.: 10/004,869

(22) Filed: Dec. 7, 2001

(65) Prior Publication Data

US 2003/0106950 A1 Jun. 12, 2003

(51) Int. Cl.[7] ..... B02C 1/00
(52) U.S. Cl. ..... 241/99; 241/283
(58) Field of Search ..... 241/99, 283

(56) References Cited

U.S. PATENT DOCUMENTS 2,234,098 A * 3/1941 Wells ..... 100/349
3,428,231 A * 2/1969 Bundus ..... 225/1
3,589,276 A * 6/1971 Swallert ..... 100/90
4,088,274 A * 5/1978 Smith ..... 241/99
4,135,442 A * 1/1979 Nafziger et al. ..... 99/582
4,141,395 A * 2/1979 Arzt ..... 144/193.1
4,449,671 A * 5/1984 Martinez-Vera et al. ..... 241/36
4,730,653 A * 3/1988 Pantone et al. ..... 144/195.5
4,786,000 A * 11/1988 Weil et al. ..... 241/36
4,867,000 A * 9/1989 Lentz ..... 472/31

* cited by examiner

*Primary Examiner*—William Hong
(74) *Attorney, Agent, or Firm*—Rosenberg, Klein & Lee

(57) ABSTRACT

The present invention relates to a breaker of a reinforced glass, including a power source for driving a breaking cylinder to compress a strong spring. When the compressed strong spring is released, the strong spring may produce an instantaneous bounce force so as to drive the breaking cylinder to strongly hit and break the reinforced glass, thereby breaking the reinforced glass quickly and efficiently.

5 Claims, 3 Drawing Sheets

BREAKER OF REINFORCED GLASS

BACKGROUND OF THE INVENTION

1. Field of the Invention

The present invention relates to a breaker of a reinforced glass, and more particularly to a breaker that may produce an instantaneous bounce force to drive the breaking cylinder to strongly hit and break the reinforced glass, thereby breaking the reinforced glass quickly and efficiently.

2. Description of the Related Art

The closest prior art of which the applicant is aware is disclosed in the Taiwanese Patent Publication No. 363426, which discloses a conventional breaker which includes a box fixed on a corner of a reinforced glass window. The box contains a slide track which is fitted with a slide base which has a front side secured with a motor which has a rotation shaft connected to a gravity rod that is rested on the reinforced glass window. The slide track has a rear side provided with a strong spring pushing the slide base.

Thus, when an accident happens, and it is necessary to hit and break the reinforced glass window, the motor may drive the gravity rod to rotate at a high speed, so that the conic head of the gravity rod may be pushed by the strong spring to drill a hole in the reinforced glass window, so as to break the reinforced glass window, thereby achieving the purpose of escape.

However, the conventional breaker of a reinforced glass window has the following disadvantages.

1. The strong spring is disposed at a compressed state during a long period of time, so that the strong spring easily produces an elastic fatigue, thereby failing the breaker.

2. The conic head of the gravity rod pushed by the strong spring needs to take a great deal of time so as to drill a hole in the reinforced glass window, thereby wasting time of escape.

3. The conic head of the gravity rod pushed by the strong spring can only drill a small hole in the reinforced glass window, and the user has to use other article to break and enlarge the small hole for escape, thereby wasting time of escape.

SUMMARY OF THE INVENTION

The present invention has arisen to mitigate and/or obviate the disadvantage of the conventional breaker of a reinforced glass window.

The primary objective of the present invention is to provide a breaker that may produce an instantaneous bounce force to drive the breaking cylinder to strongly hit and break the reinforced glass, thereby breaking the reinforced glass quickly and efficiently.

In accordance with the present invention, there is provided a breaker of a reinforced glass, comprising: a body, having a first end formed with a closed end, and a second end having an end face formed with a slide groove and a through hole in parallel with each other, a breaking cylinder slidably mounted in the through hole, an elastic member mounted in the breaking cylinder and rested on the closed end of the body, a slide base slidably mounted in the slide groove, a power source mounted in the body for moving the slide base, a clutch device mounted on the slide base and detachably locked on one end of the breaking cylinder.

Preferably, the closed end of the body is sealed by a support plate, the closed end of the body is formed with a receiving groove communicated with the slide groove, the closed end of the body is formed with a guide groove that is communicated with and has an inner diameter greater than that of the through hole, and a connecting hole is connected between the slide groove and the through hole of the body.

Preferably, the power source is mounted in the receiving groove of the body, and has one end provided with a ball screw that is directed toward the slide groove, the ball screw may be driven by the power source to rotate, the ball screw is positioned and supported in the slide groove by a bearing, the slide base is slidably mounted in the slide groove, and has a center formed with a screw hole screwed on the ball screw, so that when the ball screw is rotated by the power source, the slide base may slide on the ball screw by guidance of the slide groove.

Preferably, the clutch device is a clutch swing bar, the slide base has one side formed with two pivot ears received in the connecting hole of the body for pivoting the clutch swing bar which may swing horizontally in the connecting hole of the body, the slide base is formed with a longitudinally extended cutout located between the two pivot ears, a guide rod has a first end inserted into the cutout of the slide base, and a second end screwed on a side face of the body, the clutch swing bar has a first end pivotally mounted between the two pivot ears of the slide base, and a second end having a first side formed with a protruded stop portion and a second side formed with a protruded guide portion, the stop portion of the clutch swing bar has a free end formed with a circular nose end, the guide portion of the clutch swing bar has a free end pivoted with a roller, the stop portion of the clutch swing bar is rested on the end face of the breaking cylinder, and the roller of the guide portion of the clutch swing bar is rested on the guide rod of the slide base.

Preferably, the breaking cylinder is slidably mounted in the guide groove and the through hole of the body, and has a closed first end provided with a striking needle, and a second end having an outer periphery formed with an annular locking flange that may be rested and locked in the guide groove of the body, and the breaking cylinder has an inner portion formed with a chamber for receiving the strong spring which is rested on a support plate.

Further benefits and advantages of the present invention will become apparent after a careful reading of the detailed description with appropriate reference to the accompanying drawings.

DETAILED DESCRIPTION OF THE INVENTION

Figure 1:
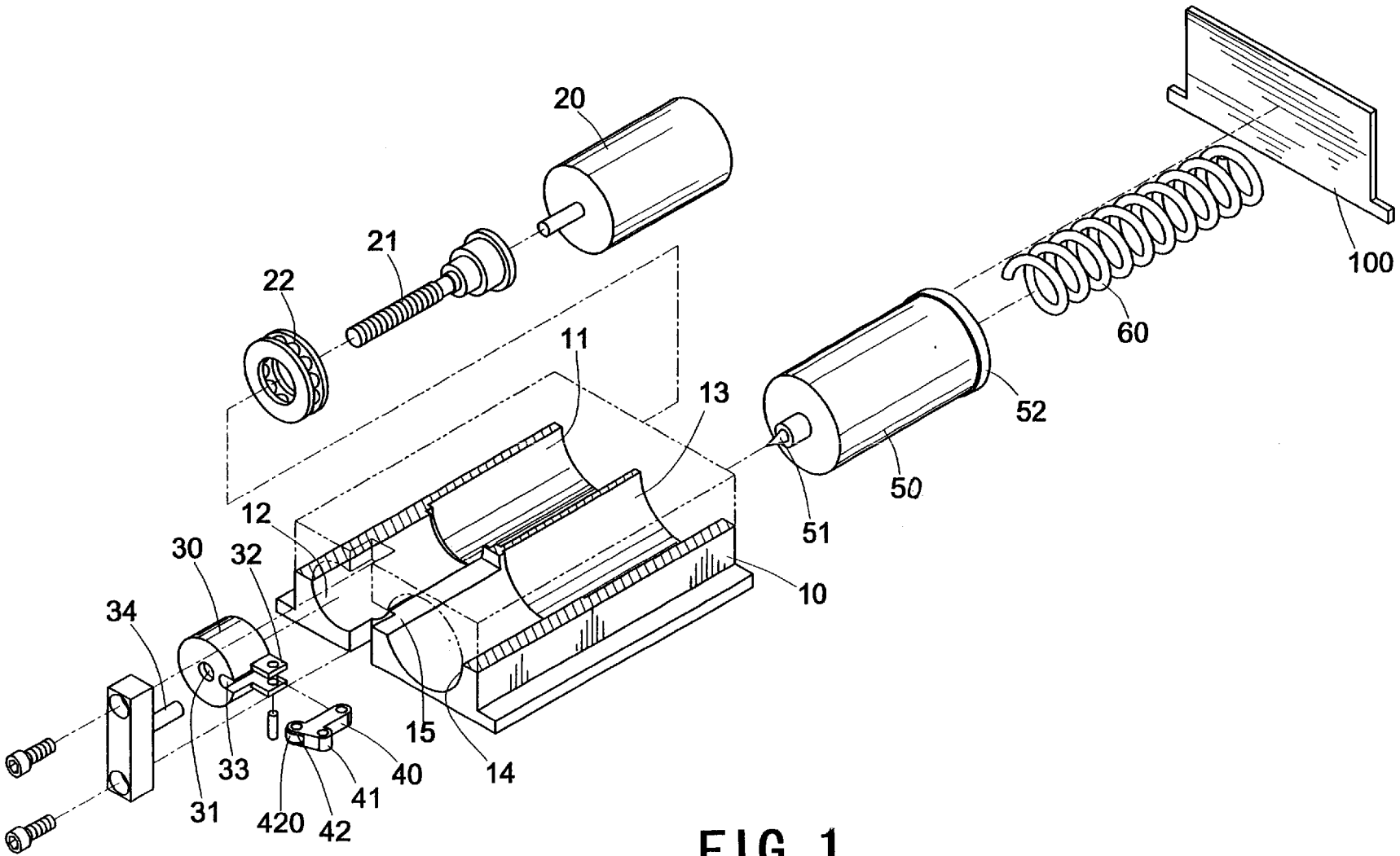
FIG. 1 is an exploded perspective view of a breaker of a reinforced glass in accordance with a preferred embodiment of the present invention.
Figure 2:
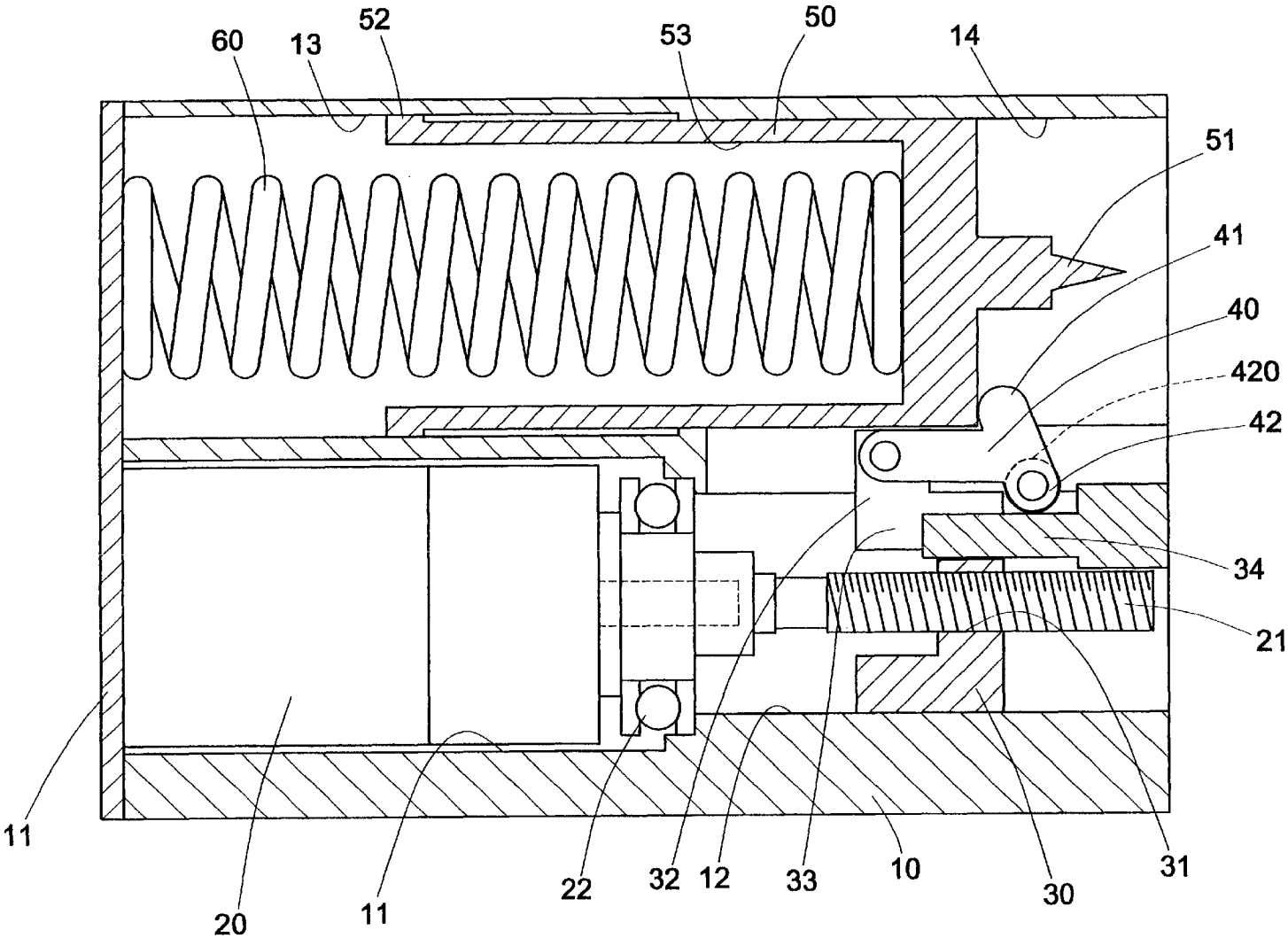
FIG. 2 is a plan cross-sectional assembly view of the breaker of a reinforced glass as shown in FIG. 1.

Referring to the drawings and initially to FIGS. 1 and 2, a breaker of a reinforced glass in accordance with a preferred embodiment of the present invention comprises a body 10, a power source 20, a slide base 30, a clutch swing bar 40, a breaking cylinder 50, and a strong spring 60.

The body 10 is a rectangular base, and has a first end face and a second end face. The first end face of the body 10 is formed with a receiving groove 11, and a guide groove 13 located in parallel with the receiving groove 11. The second end face of the body 10 is formed with a slide groove 12 that is communicated with the receiving groove 11 and has an inner diameter smaller than that of the receiving groove 11. The second end face of the body 10 is also formed with a through hole 14 that is communicated with the guide groove 13 and has an inner diameter smaller than that of the guide groove 13. The through hole 14 is located in parallel with the slide groove 12. The second end face of the body 10 is formed with a connecting hole 15 that is connected between the slide groove 12 and the through hole 14.

The power source 20 is received in the receiving groove 11 of the body 10, and has one end provided with a ball screw 21 that is directed toward the slide groove 12. The ball screw 21 may be driven by the power source 20 to rotate. The ball screw 21 is positioned and supported in the slide groove 12 by a bearing 22.

The slide base 30 is slidably mounted in the slide groove 12, and has a center formed with a screw hole 31 screwed on the ball screw 21, so that when the ball screw 21 is rotated by the power source 20, the slide base 30 may slide on the ball screw 21 by guidance of the slide groove 12. The slide base 30 has one side formed with two pivot ears 32 received in the connecting hole 15 of the body 10 for pivoting the clutch swing bar 40, so that the clutch swing bar 40 may swing horizontally in the connecting hole 15 of the body 10.

The clutch swing bar 40 has a first end pivotally mounted between the two pivot ears 32 of the slide base 30, and a second end having a first side formed with a protruded stop portion 41 and a second side formed with a protruded guide portion 42. The stop portion 41 of the clutch swing bar 40 has a free end formed with a circular nose end. The guide portion 42 of the clutch swing bar 40 has a free end pivoted with a roller 420.

The slide base 30 is formed with a longitudinally extended cutout 33 located between the two pivot ears 32. A guide rod 34 has a first end inserted into the cutout 33 of the slide base 30, and a second end screwed on a side face of the body 10.

The breaking cylinder 50 is slidably mounted in the guide groove 13 and the through hole 14 of the body 10, and has a closed first end provided with a striking needle 51, and a second end having an outer periphery formed with an annular locking flange 52 that may be rested and locked on a shoulder formed between the guide groove 13 and the through hole 14 of the body 10. The breaking cylinder 50 has an inner portion formed with a chamber 53 (see FIG. 2) for receiving the strong spring 60. A support plate 100 is secured on one side of the body 10, so that the strong spring 60 may be compressed between the support plate 100 and the wall of the chamber 53 of the breaking cylinder 50.

As shown in FIG. 2, when the breaking cylinder 50 is mounted in the through hole 14 of the body 10, the stop portion 41 of the clutch swing bar 40 is rested on the end face of the breaking cylinder 50, and the roller 420 of the guide portion 42 of the clutch swing bar 40 is rested on the guide rod 34 of the slide base 30.

Figure 3:
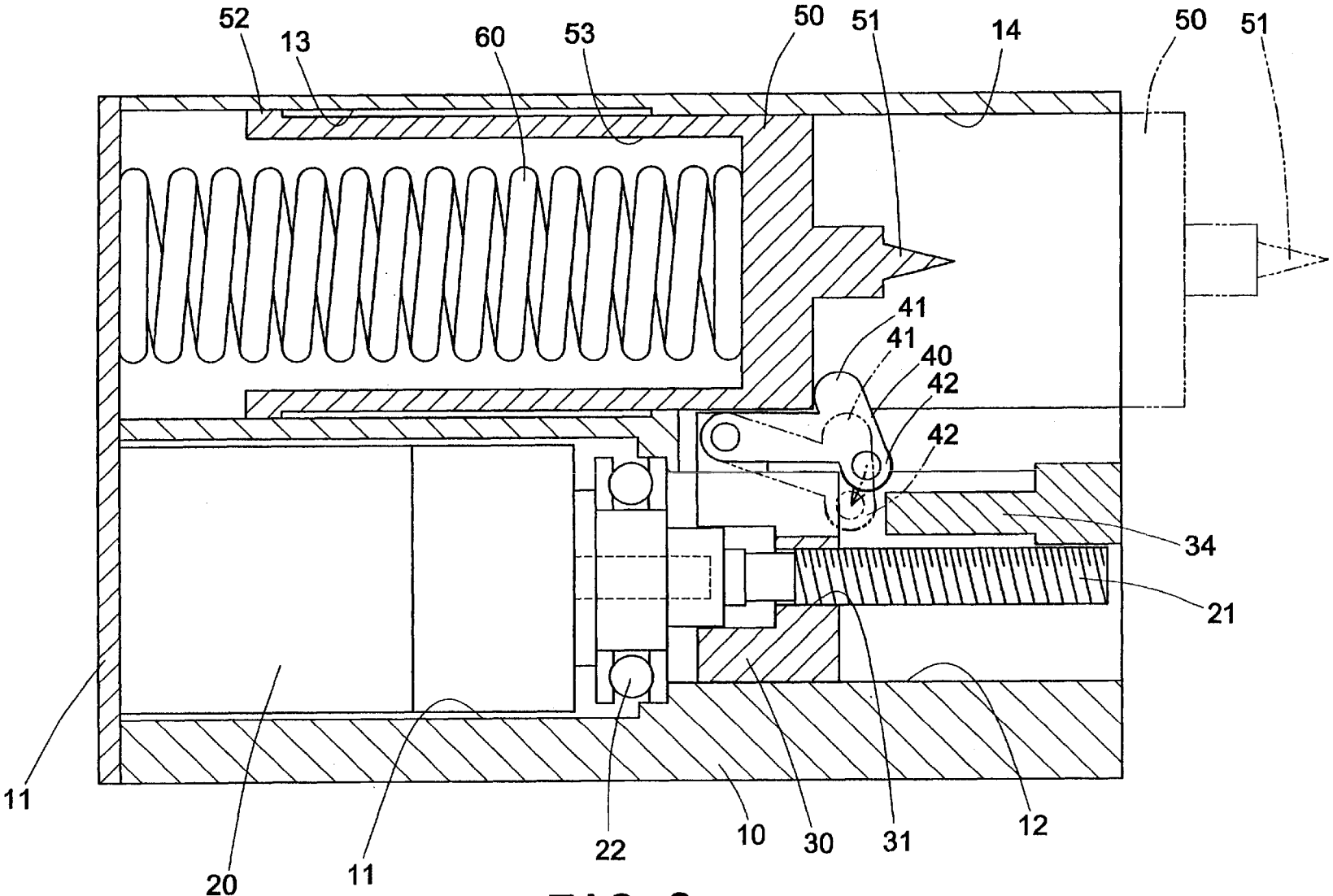
FIG. 3 is a schematic operational view of the breaker of a reinforced glass as shown in FIG. 2 in use.

In use, referring to FIGS. 2 and 3 with reference to FIG. 1, the through hole 14 of the body 10 is directed toward the reinforced glass to be hit. The ball screw 21 may be driven and rotated by the power source 20, so that the slide base 30 may be driven by the ball screw 21 to slide in the guide groove 12 toward the power source 20, and the clutch swing bar 40 may be moved with the slide base 20 to move toward the power source 20, whereby the roller 420 of the guide portion 42 of the clutch swing bar 40 may slide along the guide rod 34 of the slide base 30, and the stop portion 41 of the clutch swing bar 40 may push the breaking cylinder 50 to move toward the strong spring 60, thereby compressing the strong spring 60 as shown in FIG. 3.

When the slide base 30 is moved to a predetermined position, the guide portion 42 of the clutch swing bar 40 is moved outward from the guide rod 34 of the slide base 30, so that the guide portion 42 of the clutch swing bar 40 is located at a suspending state as shown in FIG. 3, whereby the force of the stop portion 41 of the clutch swing bar 40 applied on the breaking cylinder 50 is removed, so that the restoring force of the strong spring 60 applied on the breaking cylinder 50 may force the clutch swing bar 40 to pivot about the pivot ears 32, thereby detaching the breaking cylinder 50 from the stop portion 41 of the clutch swing bar 40, whereby the breaking cylinder 50 may be forced to move outward from the through hole 14 of the body 10 by the restoring force of the strong spring 60, so that the striking needle 51 of the breaking cylinder 50 may be pushed to instantaneously strike and break the reinforced glass quickly and strongly, and the broken reinforced glass may be hit by the end face of the breaking cylinder 50, thereby forming a larger opening to facilitate escape of the people.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A breaker of a reinforced glass, comprising: a body, having a first end formed with a closed end, and a second end having an end face formed with a slide groove and a through hole in parallel with each other, a breaking cylinder slidably mounted in the through hole, an elastic member mounted in the breaking cylinder and rested on the closed end of the body, a slide base slidably mounted in the slide groove, a power source mounted in the body for moving the slide base, a clutch device mounted on the slide base and detachably locked on one end of the breaking cylinder.

2. The breaker of a reinforced glass in accordance with claim 1, wherein the closed end of the body is sealed by a support plate, the closed end of the body is formed with a receiving groove communicated with the slide groove, the closed end of the body is formed with a guide groove that is communicated with and has an inner diameter greater than that of the through hole, and a connecting hole is connected between the slide groove and the through hole of the body.

3. The breaker of a reinforced glass in accordance with claim 2, wherein the power source is mounted in the receiving groove of the body, and has one end provided with a ball screw that is directed toward the slide groove, the ball screw may be driven by the power source to rotate, the ball screw is positioned and supported in the slide groove by a bearing, the slide base is slidably mounted in the slide groove, and has a center formed with a screw hole screwed on the ball screw, so that when the ball screw is rotated by the power source, the slide base may slide on the ball screw by guidance of the slide groove.

4. The breaker of a reinforced glass in accordance with claim 2, wherein the clutch device is a clutch swing bar, the slide base has one side formed with two pivot ears received in the connecting hole of the body for pivoting the clutch swing bar which may swing horizontally in the connecting hole of the body, the slide base is formed with a longitudinally extended cutout located between the two pivot ears, a guide rod has a first end inserted into the cutout of the slide base, and a second end screwed on a side face of the body, the clutch swing bar has a first end pivotally mounted between the two pivot ears of the slide base, and a second end having a first side formed with a protruded stop portion and a second side formed with a protruded guide portion, the stop portion of the clutch swing bar has a free end formed with a circular nose end, the guide portion of the clutch swing bar has a free end pivoted with a roller, the stop portion of the clutch swing bar is rested on the end face of the breaking cylinder, and the roller of the guide portion of the clutch swing bar is rested on the guide rod of the slide base.

5. The breaker of a reinforced glass in accordance with claim 2, wherein the breaking cylinder is slidably mounted in the guide groove and the through hole of the body, and has a closed first end provided with a striking needle, and a second end having an outer periphery formed with an annular locking flange that may be rested and locked in the guide groove of the body, and the breaking cylinder has an inner portion formed with a chamber for receiving the strong spring which is rested on a support plate.

* * * * *